US008087450B2

(12) United States Patent
Nycz et al.

(10) Patent No.: US 8,087,450 B2
(45) Date of Patent: Jan. 3, 2012

(54) FUMED METAL OXIDES FOR INVESTMENT CASTING

(75) Inventors: Shawn Nycz, Piscataway, NJ (US); Robert Johnson, Jersey City, NJ (US); Fred Klaessig, Doylestown, PA (US)

(73) Assignee: Evonik Degussa Corporation, Parsippany, NJ (US)

( * ) Notice: Subject to any disclaimer, the term of this patent is extended or adjusted under 35 U.S.C. 154(b) by 524 days.

(21) Appl. No.: 12/021,927

(22) Filed: Jan. 29, 2008

(65) Prior Publication Data

US 2008/0210844 A1 Sep. 4, 2008

Related U.S. Application Data

(60) Provisional application No. 60/978,620, filed on Oct. 9, 2007, provisional application No. 60/887,030, filed on Jan. 29, 2007.

(51) Int. Cl.
*B22C 9/04* (2006.01)

(52) U.S. Cl. ..... 164/516; 164/361

(58) Field of Classification Search ..... 164/516, 164/361

See application file for complete search history.

(56) References Cited

U.S. PATENT DOCUMENTS

| | | | | |
|---|---|---|---|---|
| 2,139,013 | A | | 12/1938 | Grace et al. |
| 2,182,128 | A | | 12/1939 | Kuzell |
| 2,182,129 | A | | 12/1939 | Kuzell |
| 2,668,750 | A | | 2/1954 | Krehma |
| 3,031,322 | A | | 4/1962 | Bugosh |
| 3,177,161 | A | | 4/1965 | Smith-Johannsen |
| 3,206,154 | A | | 9/1965 | Demaison |
| 3,284,862 | A | * | 11/1966 | Schweikert ..... 164/361 |
| 3,574,646 | A | | 4/1971 | Wismer et al. |
| 3,648,760 | A | | 3/1972 | Cooper |
| 3,655,414 | A | | 4/1972 | Hoffman et al. |
| 3,680,625 | A | | 8/1972 | Hein et al. |
| 3,688,832 | A | | 9/1972 | Horton |
| 3,692,088 | A | | 9/1972 | Kulig |
| 3,717,485 | A | | 2/1973 | Larson |
| 3,722,574 | A | | 3/1973 | Anderson et al. |
| 3,751,276 | A | | 8/1973 | Beyer et al. |
| 3,755,897 | A | | 9/1973 | Kurer |
| 3,755,915 | A | | 9/1973 | Nagell |
| 3,767,458 | A | | 10/1973 | Moore, Jr. |
| 3,802,046 | A | | 4/1974 | Wachtell et al. |
| 3,835,913 | A | | 9/1974 | Vandemark et al. |
| 3,836,372 | A | | 9/1974 | Horton |
| 3,838,998 | A | | 10/1974 | Matthews et al. |
| 3,840,632 | A | | 10/1974 | Maxion et al. |
| 3,854,962 | A | | 12/1974 | Speyer |
| 3,857,435 | A | | 12/1974 | Burkert et al. |
| 3,859,153 | A | | 1/1975 | Beyer et al. |
| 3,860,476 | A | | 1/1975 | Moore, Jr. |
| 3,866,448 | A | | 2/1975 | Dennis et al. |
| 3,870,444 | A | | 3/1975 | Herron |
| 3,880,790 | A | | 4/1975 | McLaren et al. |
| 3,887,382 | A | | 6/1975 | Solomon |
| 3,892,579 | A | | 7/1975 | Mabie, Jr. |
| 3,894,572 | A | | 7/1975 | Moore, Jr. |
| 3,909,157 | A | | 9/1975 | Wachtell et al. |
| 3,910,798 | A | | 10/1975 | Shires et al. |
| 3,920,947 | A | | 11/1975 | Wachtell et al. |
| 3,921,271 | A | | 11/1975 | Dennis et al. |
| 3,921,343 | A | | 11/1975 | Speyer |
| 3,994,739 | A | | 11/1976 | Cassidy et al. |
| 4,019,558 | A | * | 4/1977 | Szabo ..... 164/516 |
| 4,050,500 | A | | 9/1977 | Steinbacher |
| 4,131,475 | A | | 12/1978 | Svec |
| 4,162,238 | A | | 7/1979 | Bergna |
| 4,216,133 | A | | 8/1980 | Johnson et al. |
| 4,297,309 | A | | 10/1981 | North |
| 4,316,744 | A | | 2/1982 | Bergna |
| 4,602,667 | A | | 7/1986 | Moore et al. |
| 4,929,403 | A | | 5/1990 | Audsley |
| 4,989,664 | A | | 2/1991 | Roth |
| 5,273,104 | A | | 12/1993 | Renaud et al. |
| 5,391,606 | A | | 2/1995 | Doles |
| 5,683,654 | A | | 11/1997 | Dallmier et al. |
| 5,795,487 | A | | 8/1998 | Dallmier et al. |
| 5,824,730 | A | | 10/1998 | Guerra, Jr. |
| 5,827,363 | A | | 10/1998 | Darsillo et al. |
| 5,858,900 | A | | 1/1999 | Azizian et al. |
| 5,911,269 | A | | 6/1999 | Brander et al. |
| 5,958,168 | A | | 9/1999 | Liu et al. |

(Continued)

FOREIGN PATENT DOCUMENTS

| | | |
|---|---|---|
| CA | 2285792 | 4/2000 |

(Continued)

OTHER PUBLICATIONS

Batz-Sohn, C. et al., "Tailor-made silica and alumina for ink jet media coatings," IS&T's NIP20: 2004 International Conference on Digital Printing Technologies, Salt Lake City, Utah (2004) p. 805-810.

Bauer, W.C. et al., "Engineered Materials Handbook, vol. 4: Ceramics and Glasses," ed. S.J. Schneider, Jr., ASM International, Materials Park, OH (1991) 378-385.

Email from Robert Johnson at Degussa Corporation, as well as attachments, including: "AERODISP® the trusted value of AEROSIL® . . . in a convenient form," brochure; "AERODISP® W 7520 N Alkaline dispersion of hydrophilic fumed silica," Product Information Sheet; "VP Disp. W 7330 N, Alkaline dispersion of hydrophilic fumed silica," Preliminary Product Information; and AEROSIL® Invented to improve, Dispersions brochure; (Jan. 31, 2006) 53 pages.

(Continued)

*Primary Examiner* — Kuang Lin

(74) *Attorney, Agent, or Firm* — Michael Best & Friedrich LLP

(57) ABSTRACT

Investment casting shells are manufactured by incorporating fumed metal oxide dispersions, or doped fumed metal oxides as a binder into the casting shell. The investment casting shells containing the fumed metal oxides have improved characteristics, such as increased strength and a reduced surface roughness.

13 Claims, 2 Drawing Sheets

U.S. PATENT DOCUMENTS

| | | | | |
|---|---|---|---|---|
| 6,000,457 | A | 12/1999 | Vandermeer | |
| 6,015,782 | A | 1/2000 | Petri et al. | |
| 6,020,415 | A | 2/2000 | Guerra, Jr. | |
| 6,102,099 | A * | 8/2000 | Sturgis et al. | 164/4.1 |
| 6,136,205 | A | 10/2000 | Dallmier et al. | |
| 6,203,899 | B1 | 3/2001 | Hirose et al. | |
| 6,270,837 | B1 | 8/2001 | Liu et al. | |
| 6,279,722 | B1 | 8/2001 | Bankuty et al. | |
| 6,284,819 | B1 | 9/2001 | Darsillo et al. | |
| 6,328,944 | B1 | 12/2001 | Mangold et al. | |
| 6,365,264 | B2 | 4/2002 | Darsillo et al. | |
| 6,384,126 | B1 | 5/2002 | Pirtle et al. | |
| 6,403,162 | B1 | 6/2002 | Tokunaga et al. | |
| 6,417,264 | B1 | 7/2002 | Kono et al. | |
| 6,420,039 | B1 | 7/2002 | Field et al. | |
| 6,540,013 | B1 | 4/2003 | Doles | |
| 6,613,300 | B2 | 9/2003 | Mangold et al. | |
| 6,676,719 | B2 * | 1/2004 | Lortz et al. | 51/308 |
| 6,677,389 | B2 | 1/2004 | Fukuda et al. | |
| 6,680,109 | B1 | 1/2004 | Plambeck-fisher et al. | |
| 6,692,813 | B1 | 2/2004 | Elder | |
| 6,749,006 | B1 | 6/2004 | Yang et al. | |
| 6,752,864 | B2 | 6/2004 | Meyer et al. | |
| 6,808,769 | B2 | 10/2004 | Batz-Sohn et al. | |
| 6,821,462 | B2 | 11/2004 | Schulman et al. | |
| 6,840,992 | B2 | 1/2005 | Glaum et al. | |
| 6,860,714 | B1 | 3/2005 | Mcnulty et al. | |
| 6,863,113 | B2 | 3/2005 | El-Demallawy et al. | |
| 6,863,775 | B2 | 3/2005 | Bobsein et al. | |
| 6,880,928 | B2 | 4/2005 | Hosoi et al. | |
| 6,991,022 | B2 | 1/2006 | Vandermeer et al. | |
| 7,015,270 | B2 | 3/2006 | Scharfe et al. | |
| 7,048,034 | B2 | 5/2006 | Vandermeer et al. | |
| 2002/0041952 | A1 | 4/2002 | Murota et al. | |
| 2003/0095905 | A1 | 5/2003 | Scharfe et al. | |
| 2003/0168200 | A1 | 9/2003 | Vandermeer | |
| 2004/0106697 | A1 | 6/2004 | Lortz et al. | |
| 2004/0134634 | A1 | 7/2004 | Yang et al. | |
| 2004/0195296 | A1 * | 10/2004 | Schedler et al. | 228/194 |
| 2005/0061471 | A1 | 3/2005 | Connors et al. | |
| 2006/0154994 | A1 | 7/2006 | Schumacher et al. | |
| 2006/0235143 | A1 * | 10/2006 | Muller et al. | 524/588 |
| 2007/0227683 | A1 * | 10/2007 | Judge et al. | 164/28 |
| 2008/0099180 | A1 * | 5/2008 | Weicker et al. | 164/529 |
| 2010/0018666 | A1 * | 1/2010 | Gigliotti et al. | 164/519 |

FOREIGN PATENT DOCUMENTS

| | | |
|---|---|---|
| EP | 0539317 | 4/1993 |
| GB | 1159861 | 7/1969 |
| JP | 2003193038 | 7/2003 |
| WO | WO 84/01954 | 5/1984 |
| WO | WO 85/02483 | 6/1985 |
| WO | WO 85/02837 | 7/1985 |
| WO | WO 88/00931 | 2/1988 |
| WO | WO 90/03956 | 4/1990 |
| WO | WO 91/15094 | 10/1991 |
| WO | WO 92/15650 | 9/1992 |
| WO | WO 93/21128 | 10/1993 |
| WO | WO 93/25296 | 12/1993 |
| WO | WO 94/03657 | 2/1994 |
| WO | WO 95/03903 | 2/1995 |
| WO | WO 95/28363 | 10/1995 |
| WO | WO 96/08451 | 3/1996 |
| WO | WO 96/09999 | 4/1996 |
| WO | WO 96/17896 | 6/1996 |
| WO | WO 96/25371 | 8/1996 |
| WO | WO 97/13823 | 4/1997 |
| WO | WO 97/22670 | 6/1997 |
| WO | WO 97/30000 | 8/1997 |
| WO | WO 99/24158 | 5/1999 |
| WO | WO 99/32418 | 7/1999 |
| WO | WO 99/32679 | 7/1999 |
| WO | WO 99/38932 | 8/1999 |
| WO | WO 99/38933 | 8/1999 |
| WO | WO 99/47472 | 9/1999 |
| WO | WO 99/59201 | 11/1999 |
| WO | WO 00/02525 | 1/2000 |
| WO | WO 00/47339 | 8/2000 |
| WO | WO 00/47532 | 8/2000 |
| WO | WO 01/12451 | 2/2001 |
| WO | WO 01/14284 | 3/2001 |
| WO | WO 01/18102 | 3/2001 |
| WO | WO 01/41954 | 6/2001 |
| WO | WO 01/60943 | 8/2001 |
| WO | WO 02/26647 | 4/2002 |
| WO | WO 02/076905 | 10/2002 |
| WO | WO 02/100571 | 12/2002 |
| WO | WO 03/013688 | 2/2003 |
| WO | WO 03/035279 | 5/2003 |
| WO | WO 03/092095 | 11/2003 |
| WO | WO 03/099828 | 12/2003 |
| WO | WO 2004/011571 | 2/2004 |
| WO | WO 2004/027104 | 6/2004 |
| WO | WO 2004/050377 | 6/2004 |
| WO | WO 2004/054928 | 7/2004 |
| WO | WO 2004/060328 | 7/2004 |
| WO | WO 2004/085311 | 10/2004 |
| WO | WO 2004/089816 | 10/2004 |
| WO | WO 2004/089825 | 10/2004 |
| WO | WO 2004/110951 | 12/2004 |
| WO | WO 2005/030460 | 4/2005 |
| WO | WO 2005/058767 | 6/2005 |
| WO | WO 2005/061385 | 7/2005 |
| WO | WO 2005/091902 | 10/2005 |
| WO | WO 2005/123980 | 12/2005 |
| WO | WO 2006/010523 | 2/2006 |
| WO | WO 2006/067127 | 6/2006 |
| WO | WO 2006/067131 | 6/2006 |
| WO | WO 2006/070903 | 7/2006 |
| WO | WO 2006/083668 | 8/2006 |
| WO | WO 2006/083796 | 8/2006 |
| WO | WO 2006/107345 | 10/2006 |
| WO | WO 2006/135452 | 12/2006 |
| WO | WO 2007/005729 | 1/2007 |
| WO | WO 2007/015909 | 2/2007 |
| WO | WO 2007/015911 | 2/2007 |
| WO | WO 2007/021705 | 2/2007 |
| WO | WO 2007/089230 | 8/2007 |
| WO | WO 2007/143437 | 12/2007 |
| WO | WO 2008/006053 | 1/2008 |
| WO | WO 2008/094928 | 8/2008 |

OTHER PUBLICATIONS

Mitani, Y. et al., "Dispersibility of fumed silica in simple media," J. Ceramic Soc. Japan Int. Ed. (1993) 101(6):707-712.

Nycz, S. et al., Building investment casting shells with AERODISP fumed silica dispersions, at Investment Casting Institute 55th Technical Conference and Expo, Oct. 16, 2007, 20 pages.

Rusher, R.L., "Strength factors of ceramic shell molds," Cast Metals Research Journal (1974) 10(4):149-153.

International Search Report and Written Opinion for International Application No. PCT/US2008/052337 dated May 27, 2008 (9 pages).

* cited by examiner

FUMED METAL OXIDES FOR INVESTMENT CASTING

CROSS-REFERENCE TO RELATED APPLICATIONS

This application claims priority to U.S. Provisional Patent Application Ser. No. 60/887,030 filed on Jan. 29, 2007 and also to U.S. Provisional Patent Application Ser. No. 60/978,620 filed on Oct. 9, 2007, the entire contents of each of which are hereby incorporated by reference.

BACKGROUND OF THE INVENTION

Shell-molds for investment casting may be made by applying a slurry containing a binder and a refractory powder to a wax or plastic pattern of the desired form. The slurry coats the wax, and excess slurry is allowed to drain off. A coarser refractory powder (the "stucco") may be optionally applied onto the wet wax pattern, and this combination allowed to dry. Additional coatings of slurry and stucco may be applied until the mold has the required thickness and potential strength. The wax may then be removed. Molten metal may then be poured into the shell-mold and cooled to produce a metal casting.

SUMMARY OF THE INVENTION

In one aspect, the invention provides an investment casting shell comprising refractory particles, a colloidal silica and a fumed metal oxide having a median secondary particle size of less than about 300 nm. In one embodiment, the fumed metal oxide may comprise fumed silica.

In another aspect, the invention provides a method for improving the strength of an investment casting shell by incorporating an aqueous dispersion of fumed metal oxide into the shell.

In another aspect, the invention provides a method of manufacturing an investment casting shell by incorporating a dispersion of fumed metal oxide into a refractory slurry.

In another aspect, the invention provides a method of manufacturing an investment casting shell comprising incorporating a doped fumed metal oxide into the shell. Suitably, the doped fumed metal oxide is incorporated as a dispersion. In one embodiment, the doped fumed metal oxide is doped fumed silica.

DETAILED DESCRIPTION

Figure 1:
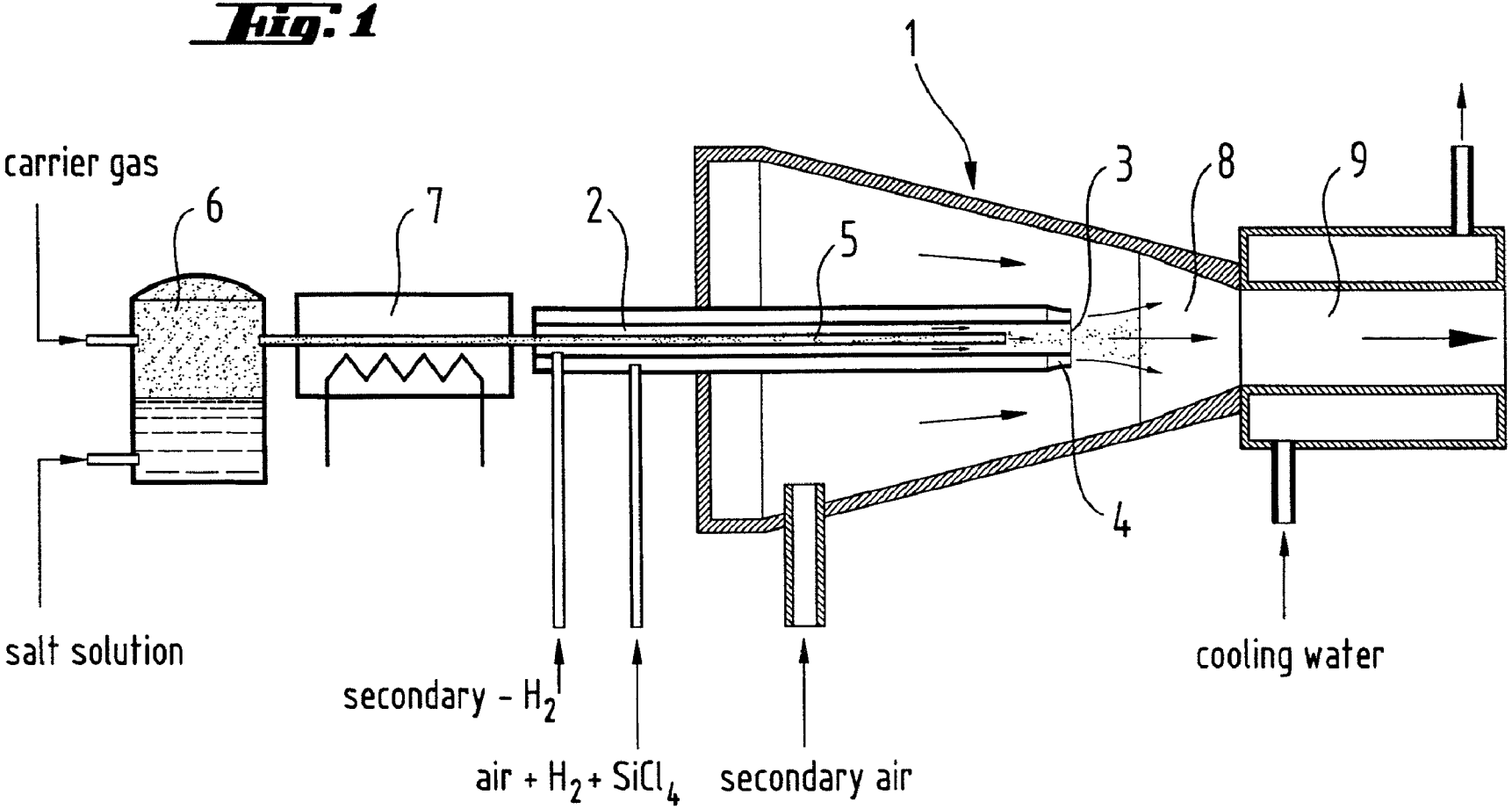
FIG. 1 is a schematic diagram of an apparatus suitable for manufacturing doped fumed metal oxides.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any nonclaimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention provides novel binders useful in forming investment mold casts. Binders used in the manufacture of investment casts include colloidal silica and ethyl silicate or sodium silicate. The present inventors have surprisingly discovered that when a fumed metal oxide dispersion, a dispersible fumed metal oxide, a doped fumed metal oxide or a fumed metal oxide having a particular median secondary particle size is used as a binder in the production of shell-molds, stronger and more durable shell molds can be made. The shell may be formed by depositing one or more layers of a slurry comprising the fumed metal oxide onto a meltable or removable pattern. The layers of slurry may be alternated with layers of dry refractory grains or powder. The casting shell may be fired and may be used as a mold to receive or contain molten metal. Suitably, a casting shell may also be formed by pouring a slurry comprising the dispersed fumed metal oxide into a pattern or mold. Suitably, the fumed metal oxide dispersions are stable dispersions.

As used herein, a fumed metal oxide encompasses fumed silica, as well as other fumed metal oxides. Examples of other fumed metals oxides include, but are not limited to, at least one of $TiO_2$, $Al_2O_3$, $B_2O_3$, $ZrO_2$, $GeO_2$, $WO_3$, $Nb_2O_5$ and combinations thereof. The fumed metal oxides may be used in combination with each other, and with other binders, such as colloidal silica. For example, fumed alumina may be used with fumed silica; fumed silica may be used with fumed titania.

A binder is a metal oxide that is capable of forming a colloid in a liquid, for example, in water or ethanol. The binder locks the refractory particles together, providing strength and durability to the shell mold. The binder typically has a large surface area. Suitable binders include colloidal silica, ethyl silicate, sodium silicate, colloidal alumina, colloidal zirconia, dispersible fumed metal oxides, fumed metal oxide dispersions, doped fumed metal oxides and fumed metal oxides having particular median secondary particles sizes.

Colloidal silica particles are generally produced by "wet chemistry" processes and have the chemical composition $SiO_2$. Typically, colloidal silica is produced by the addition of an acid to an alkaline metal silicate solution (e.g., sodium silicate solution), thereby causing the silicate to polymerize and form discrete particles of amorphous silica. Colloidal silica particles, typically, are discrete, substantially spherical silica particles having no internal surface area. Commercially available colloidal silicas include, but are not limited to, those sold under the trademarks LUDOX® (Grace Davison), BINDZIL™ (Akzo Nobel), and NYACOL™ (Akzo Nobel). Ethyl silicate binder is suitably in the form of complex silicate acids in ethanol.

As generally understood in the art, fumed metal oxides contain agglomerated or aggregated clusters of primary particles. The "primary particles" of fumed metal oxides are understood to be the smallest particles that are visible in high-resolution TEM images, which can not be broken down any further. Primary particles range in size from about 5 nm to about 100 nm. Several primary particles can congregate at their points of contact to form a secondary structure. As used herein, the "secondary particle size" of fumed metal oxides refers to the final size of the congregated particles, and includes both aggregates and, when present, agglomerates. The secondary particle size of fumed metal oxides may be measured using light scattering analysis, and a D50 (median) particle size calculated. Devices suitable for measuring secondary particle sizes, such as the Partica LA-950 Particle Size Distribution Analyzer, commercially available from Horiba, Ltd., Japan, are known in the art. Aggregates are clusters of two or more primary particles that are either impossible or very difficult to break down using dispersing devices. The primary particles of an aggregate are sintered together. Agglomerates are comprised of two or more aggregates that are joined together loosely. In an agglomerate, the aggregated particles may be held together by electrostatic forces and Van der Waals forces. Agglomerates form when fumed metal oxides are produced. Agglomerates may be broken down to smaller agglomerates and aggregates, for example, upon exposure to conditions sufficient to form a fumed metal oxide dispersion.

Fumed metal oxides in dry form have a median secondary particle size (D50) of between about 3 μm and about 3 mm, and at least about 90% of the secondary particles have a size larger than about 1 μm. For example, the dry fumed silica AEROSIL® 200 SP has a primary particle size of 12 nm, a D50 secondary particle size of 25 μm and a D90 secondary particle size of 65 μm. Unless modified, fumed metal oxides will not form a dispersion in water.

Dispersible fumed metal oxides (e.g. dispersible fumed silica) contain irregularly structured aggregates that are smaller than the agglomerates of dry fumed metal oxides (e.g. fumed silica). As used herein, "dispersible fumed metal oxide" means a fumed metal oxide having a median secondary particle size (D50) of less than about 300 nm. One example of a dispersible fumed metal oxide is dispersible fumed silica. One example of a suitable dispersant is water.

As used herein, a "fumed metal oxide dispersion" is a dispersion comprising fumed metal oxide with at least about 50% (w/w) dispersible fumed metal oxide. As used herein, a "fumed silica dispersion" is a dispersion comprising fumed silica with at least about 50% (w/w) dispersible fumed silica particles.

When particularly treated, dry or powdered fumed metal oxide (e.g., silica) can lose its agglomerate structure and form a stable dispersion in a dispersing medium. As used herein, a "stable dispersion" means that after being allowed to sit without movement for 6 months, less than 5% by weight of the total solids have settled out of the dispersing medium. Dispersions suitable for use in the present invention may be formed, for example, as set forth in U.S. Patent Application No. 20060154994, and International Publication Nos. WO2004054928, WO2004085311, WO2004089816, WO2004089825, WO2005123980 and WO2005058767, the entire contents of each of which is herein incorporated by reference. Generally, a stable dispersion may be formed by exposing a mixture of the fumed metal oxide in an appropriate dispersing medium, such as water, to an ultra high shear. As used herein, an ultra high shear means a process in which the fluid to be mixed encounters zones of shear having a shear rate of at least about 10,000 $sec^{-1}$. Suitably, a stable dispersion may be formed when shear in excess of at least about 15,000 $sec^{-1}$, at least about 20,000 $sec^{-1}$, at least about 30,000 $sec^{-1}$, at least about 50,000 $sec^{-1}$, at least about 100,000 $sec^{-1}$ is applied. A stable dispersion may be formed using a device such as a rotor/stator disperser or a bead mill for a period sufficient to expose the entire mixture volume to ultra high shear. In some cases, the shear may be applied under pressure. The stable dispersions of fumed metal oxides or fumed silica are suitably colloids. Suitably, the stable dispersion is an aqueous dispersion of the fumed metal oxide. Fumed metal oxides in a stable dispersion have a median secondary particle size (D50) of less than about 300 nm.

The term, "fumed silica" has occasionally been loosely used in the art interchangeably with silica fume. However, as those skilled in the art appreciate, the structure of fumed silica and silica fume are very different. As discussed above, fumed silica particles comprise numerous nanometer-sized primary particles of about 5 to about 100 nm, which are aggregated and agglomerated to form larger clusters having chain-like structures. Fumed silica may be synthesized by pyrogenic processes such as by vapor phase hydrolysis of silicon tetrachloride. In contrast, silica fume, as defined by the American concrete institute (ACI) and understood in the art, is very fine non-crystalline silica produced in electric arc furnaces as a by-product of the production of elemental silicon or alloys containing silicon. Silica fume is also referred to as condensed silica fume or microsilica. About 95% of the particles of silica fume are smaller than 1 μm, with a distribution giving an average particle size of about 0.4 to 0.5 μm. The primary particles of silica fume are roughly spherical and are significantly larger than the primary particles that form fumed silica.

Suitable fumed metal oxides have a median secondary particle size of at least about 30 nm, at least about 40 nm, at least about 50 nm, at least about 60 nm, at least about 70 nm, or at least about 75 nm. Suitable fumed metal oxides have a median secondary particle size of less than about 300 nm, less than about 275 nm, less than about 250 nm, less than about 225 nm, less than about 200 nm, less than about 175 nm, or less than about 150 nm.

The fumed metal oxides may optionally be further modified, such as by doping with another metal oxide, or by surface attaching chemical moieties such as functional siloxanes or cationic polymers. Suitable doped fumed metal oxides can be made according to the techniques described in U.S. Pat. Nos. 6,328,944 and 6,613,300, the entire contents of each of which are hereby incorporated by reference. FIG. 1 shows an apparatus suitable for producing doped fumed metal oxides. A burner 1 consists of a central tube 2 which discharges into a nozzle 3, out of which the main gas stream flows into the combustion chamber 8 and is there burned off. The inner nozzle is surrounded by the further annular nozzle 4 (mantle nozzle), out of which flows mantle- or secondary-hydrogen to prevent caking. A centrally located axial tube 5 is located inside central tube 2 and terminates a few centimeters upstream of the nozzle 3 of the central tube 2. The aerosol is fed into the axial tube 5, whereby the aerosol gas stream from the axial tube 5 is homogeneously mixed with the gas stream from the central tube 2 over the last section of the central tube 2. The central tube conveys air, hydrogen and, for example, silicon tetrachloride for the pyrolysis reaction. The aerosol is produced in an aerosol generator 6 (ultrasonic nebulizer). An aqueous salt solution 9 located in the generator 6 contains the metal or non-metal as a salt in dissolved or dispersed/suspended form and is used as the aerosol starting material. The aerosol produced by the aerosol generator 6 is passed through the heating zone 7 by means of a carrier gas stream 10, whereupon the water evaporates and small, finely distributed salt crystals remain in the gas phase.

Doping components may be metals and/or non-metals and their compounds. The doping component may be added in elemental form or as ions, such as found in oxides, carbonates or other salts. The fumed metal oxide may suitably be doped with less than about 3 wt. %, less than about 2 wt. %, or less than about 1 wt. % of a doping component. Suitable doping components include noble metals, and alkaline and alkaline earth metals such as Li, Na, K, Rb, Cs, Fr, Al, Be, Mg, Ca, Sc, and Ba. Other suitable doping components include Ce, F, Cl, Br, I, At, Pb, Fe and Ti. In some embodiments, the dopant may be incorporated into the fumed metal oxide as a monovalent or divalent ion. The doped flumed metal oxides are suitably dispersible fumed metal oxides, or are provided as a stable dispersion, such as a stable aqueous dispersion.

Suitable fumed metal oxide dispersions include those commercially available from Evonik Degussa Corporation, such as AERODISP® G 1220, AERODISP® W1450, AERODISP® W7215S, AERODISP® W 1226, AERODISP® W 1714, AERODISP® W 1824, AERODISP® W 1836, AERODISP® W 630, AERODISP® W440, VP DISP W7330N, VP DISP W740X, VP DISP 2730, VP DISP 2550, AERODISP® W 7215 S, AERODISP® W 7512 S, AERODISP® W 7520, AERODISP® W 7520 N, AERODISP® W7520P, AERODISP® W 7622, AERODISP® WK 341, VP DISP W340, VP DISP W740ZX, and VP Disp W3530N; those commercially available from Cabot Corporation, such as CAB-O-SPERSE® PG 022, CAB-O-SPERSE® A 2012, CAB-O-SPERSE® 2012A, CAB-O-SPERSE® 2020K, CAB-O-SPERSE® A 2017, CAB-O-SPERSE® 2017A, CAB-O-SPERSE® 1030K, CAB-O-SPERSE® K 2020, CAB-O-SPERSE® 2020K, CAB-O-SPERSE® 4012K, CAB-O-SPERSE® PG 002CAB-O-SPERSE® PG 001, CAB-O-SPERSE® 1015A, CAB-O-SPERSE® 1020K, CAB-O-SPERSE® GP 32/12, CAB-O-SPERSE® GP 32/17, CAB-O-SPERSE® GP 50, CAB-O-SPERSE® MT 32/17, CAB-O-SPERSE® A 105, CAB-O-SPERSE® A 1095, CAB-O-SPERSE®0 A 205, CAB-O-SPERSE® A 1695, CAB-O-SPERSE® A 2095, CAB-O-SPERSE® C 1030K, CAB-O-SPERSE® C105A, CAB-O-SPERSE® K 4012, CAB-O-SPERSE® P 1010, CAB-O-SPERSE® II, CAB-O-SPERSE® A 3875, CAB-O-SPERSE® PG 001, CAB-O-SPERSE® PG 002 and CAB-O-SPERSE® CT 302C; and those commercially available from Wacker Chemie AG, such as, HDK® XK20030, HDK® A2012, HDK® 1515B, HDK® 2012B, HDK® A3017 and HDK® A3017B; and combinations thereof.

Suitable metal oxides and fumed metal oxides, suitable dispersions comprising metal oxides and fumed metal oxides and methods for making these dispersions are disclosed in United States Patent Application Publication Nos. US20060154994, US20040106697, US2003095905, US2002041952, International Publication Nos. WO2006067131, WO2006067127, WO2005061385, WO2004050377, WO9722670, Canadian Application No. CA2285792, and U.S. Pat. Nos. 7,015,270, 6,808,769, 6,840,992, 6,680,109 and 5,827,363, the entire contents of each of which is hereby fully incorporated by reference.

Other suitable metal oxides and dispersions comprising suitable metal oxides include, but are not limited to, those commercially available from Akzo Nobel/EKA Chemicals, such as BINDZIL® 15/500, BINDZIL® 30/360, BINDZIL® 30/220, BINDZIL® 305, BINDZIL® 30NH2/220, BINDZIL® 40/220, BINDZIL® 40/170, BINDZIL® 30/80, BINDZIL® CAT 80, BINDZIL® F 45, BINDZIL® 50/80, NYACOL® 215, NYACOL® 830, NYACOL® 1430, NYACOL® 1440, NYACOL® 2034DI, NYACOL® 2040, NYACOL® 2040NH4 and NYACOL® 9950; those commercially available from H.C. Stark/Bayer, such as LEVASIL® 500/15%, LEVASIL® 300/30%, LEVASIL® 300F/30%, LEVASIL® 200E/20%, LEVASIL® 200S/30%, LEVASIL® 200A/30%, LEVASIL® 200/30%, LEVASIL® 200N/30%, LEVASIL® 200/40%, LEVASIL® 100/45%, LEVASIL® 100S/30%, LEVASIL® 100/30%, LEVASIL® 50 CK 30, LEVASIL® 4063, LEVASIL® 1OOS/45%, LEVASIL® 50/50%; those commercially available from Grace Davison, such as LUDOX® SM, LUDOX® HS-30, LUDOX® LS, LUDOX® HS-40, LUDOX® AM, LUDOX® WP, LUDOX® AS, LUDOX® TM; those commercially available from Nalco Chemical, such as NALCO® 1115, NALCO® 2326, NALCO® 6011, NALCO® 1130, NALCO® 1030, NALCO® 6010, NALCO® 1140, NALCO® 2325, NALCO® 2327, NALCO® 1060, NALCO® 1034, NALCO® 1129, NALCO® 1050, NALCO® 6009; those commercially available from Nissan Chemical Industries Ltd., such as SNOWTEX® 20, SNOWTEX® 30, SNOWTEX® C, SNOWTEX® N, SNOWTEX® 0; and those commercially available from Clariant/Rodel, such as KLEBOSOL® 30N25, KLEBOSOL® 30H25, KLEBOSOL® 30N50PHN, KLEBOSOL® 30N50, KLEBOSOL® 30H50, KLEBOSOL® 1501-50, KLEBOSOL® 1508-50, KLEBOSOL® 1498-50. The investment casting shells of the invention may be made with and comprise any of these metal oxides, dispersions comprising metal oxides or combinations thereof.

One or more refractory agents may be suitably present in the slurry and stucco. Refractory agents retain their strength at high temperatures. The refractory agents used in the slurry and stucco may be the same or different. Suitable refractory agents include, but are not limited to, fused silica, silica fume, zircon, alumina, alumino-silicate, graphite, zirconia, zircon, yttria, and combinations thereof. Suitably the refractory agent is present at at least about 60%, at least about 65%, at least about 70%, at least about 75%, at least about 80%, or at least about 85% by weight of the total solids content of the slurry or investment cast mold. Suitably the refractory agent is present at less than about 99%, less than about 98%, less than about 97%, less than about 95%, less than about 93%, or less than about 90%, by weight of the total solids content of the slurry or investment cast mold.

Slurries and investment cast molds of the invention may further comprise an optional reinforcing agent. A reinforcing agent is an agent that helps strengthen the investment cast mold. Suitable reinforcing agents may comprise a fibrous or needle-like material, such as glass fibers, ceramic lamellar or needle-like crystals, carbon fibers or plastic fibers. Suitable reinforcing agents include, but are not limited to, VANSIL® W (a wollastonite commercially available from RT Vanderbilt & Co., Norwalk, Conn.), Chopped Strand 979 glass fiber (commercially available from Saint Gobain Vetrotex, Valley Forge, Pa.), and STEALTH® ⅛' polypropylene fiber (commercially available from Synthetic Industries, Inc., Chickamauga Ga.). Suitably, the reinforcing agent is present at least about 0.1%, at least about 0.05%, at least about 0.1%, at least about 0.2%, at least about 0.3% or at least about 0.4% by weight of the total solids content of the slurry or investment cast mold. Suitably, the reinforcing agent is present at less than about 5%, less than about 3%, less than about 2%, less than about 1.5%, less than about 1%, less than about 0.75%, or less than about 0.6% by weight of the total solids content of the slurry or investment cast mold.

Other optional components that may be suitably included in the slurry include organic film formers, which may improve the green strength of the investment cast mold. Suitable film formers include, but are not limited to, aqueous polyvinyl acetate emulsions, polyvinyl alcohol and ammonium alginate. Clay may also be optionally included to improve the characteristics of the slurry coating. Nucleating agents, to control grain size may also be optionally included. Suitable nucleating agents include, but are not limited to, refractory cobalt compounds, such as aluminates, silicates, titanates, oxides, and combinations thereof. Surfactants may also be optionally included, to improve the ability of the slurry to wet the wax pattern and assist in drainage. Suitable surfactants include, but are not limited to, non-ionic surfactants and anionic surfactants.

In one embodiment, a slurry or shell mold comprising fumed metal oxide is provided for investment casting in which at least about 25%, at least about 35%, at least about 45%, at least about 50%, at least about 55%, at least about 60%, at least about 65%, at least about 70%, at least about 75%, at least about 80%, at least about 85%, at least about 90%, at least about 95%, or at least about 99% of the total fumed metal oxide present in the slurry or shell mold is a dispersible fumed metal oxide, a doped fumed metal oxide or a combination thereof. The fumed metal oxide or doped fumed metal oxide may suitably be added to or present in the slurry as a stable dispersion.

The dispersible fumed metal oxide or doped fumed metal oxide may also be suitably present at at least about 0.2%, at least about 0.5%, at least about 0.75%, at least about 1%, at least about 2%, at least about 3%, at least about 4%, at least about 5%, at least about 7.5%, or at least about 10% by weight of the total green weight of the shell mold. The dispersible fumed metal oxide or doped fumed metal oxide may also be suitably present at less than about 50%, less than about 40%, less than about 30%, less than about 25%, less than about 20%, or less than about 15% by weight of the total weight of the form of the green shell mold.

Slurries may suitably contain at least about 0.5% dispersible fumed metal oxide or doped fumed metal oxide by weight of the total solids content of the slurry. The slurries may also suitably include at least about 0.75%, at least about 1%, at least about 2%, at least about 3%, at least about 4%, at least about 5%, at least about 7.5%, at least about 10%, or at least about 15% dispersible fumed metal oxide or doped fumed metal oxide by weight of the total solids content of the slurry. The slurries may suitably contain less than about 40%, less than about 35%, less than about 30%, less than about 25%, or less than about 20% by weight dispersible fumed metal oxide or doped fumed metal oxide of the total solids content of the slurry.

Molds and slurries of the invention may suitably contain a binder comprising both colloidal metal oxide and a fumed metal oxide. Suitably the fumed metal oxide is a dispersible fumed metal oxide, a doped fumed metal oxide, a doped dispersed fumed metal oxide, a fumed metal oxide having a median secondary particle size of less than about 300 nm, or is provided as a fumed metal oxide dispersion. Suitably, the binder comprises by weight at least about 0.1 parts, at least about 0.25 parts, at least about 0.5 parts, at least about 1 part, at least about 1.25 parts, at least about 1.5 parts, at least about 2 parts, at least about 2.5 parts or at least about 3 parts colloidal metal oxide per part of fumed metal oxide. Suitably, the binder comprises by weight less than about 100 parts, less than about 50 parts less than about 20 parts, less than about 15 parts, less than about 10 parts, less than about 9 parts, less than about 8 parts, less than about 7 parts, or less than about 6 parts colloidal metal oxide per part of fumed metal oxide.

Investment cast molds of the invention may exhibit superior strength characteristics than those made without a binder comprising a dispersible fumed metal oxide. For example, molds in the green state, wet state or fired state comprising a dispersible fumed metal oxide, a doped fumed metal oxide or molds made with a fumed metal oxide dispersion may exhibit an increase in the modulus of rupture measured in MPa of at least about 10%, at least about 20%, at least about 25%, at least about 30%, at least about 35%, at least about 40%, at least about 45%, at least about 50%, at least about 50%, or at least about 60% when compared with similar bars made without a binder comprising a dispersible fumed metal oxide. As used herein, the "fired strength" refers to the strength of a mold after it has been heated to temperatures above 900° C. and allowed to cool. As used herein, the "hot strength" refers to the strength of a mold at a temperature between 900° C. and 1200° C. As used herein, the "wet strength" refers to the strength of a mold that has been boiled in water for 10 minutes, and has not been allowed to dry. As used herein, and understood in the art, the "green strength" of a mold is the strength of a cast mold that has been dried but has not undergone additional treatment.

Investment cast molds of the invention may exhibit a reduced surface roughness than those made without a binder comprising a dispersible fumed metal oxide. For example, molds may exhibit a decrease in the surface roughness, measured in rms (root mean square) using a profilometer of at least about 1%, at least about 2%, at least about 5%, at least about 10%, at least about 15%, at least about 20%, or at least about 50% when compared with similar bars made without a binder comprising a dispersible fumed metal oxide.

Slurries of the invention may be suitably made by any technique known in the art. For example, the dry ingredients such as the refractory agents and a reinforcing agent, if used, may be combined using a plough mixer. The fumed metal oxide dispersion, the doped fumed metal oxide or the doped fumed metal oxide dispersion may then be added with other liquids, such as water or alcohols and mixing continued. The slurry may be suitably modified to a desirable pH with acid or alkali.

Investment casting molds are suitably formed by applying a slurry to a preformed pattern made from, for example, wax, a thermoplastic material or any other material that can be removed by melting, firing or peeling. The slurry may be allowed to dry before one or more additional layers of slurry are applied. The subsequent slurries may be the same or different from the first (prime) slurry. If desired, a stucco layer of a refractory agent may be deposited between the layers of slurry before each layer is allowed to dry. The stucco may be deposited by any method, including, but not limited to, dipping, sieving or sprinkling. Suitably the dispersible fumed metal oxide, or the doped fumed metal oxide is present throughout the shell.

Once the mold is formed and dry, the preformed pattern may be suitably removed, for example, using heat.

The following examples are illustrative and are not to be construed as limiting the scope of the invention.

EXAMPLES

Example 1

Preparation of Slurries for Investment Casting

Five different compositions were made by combining each of the ingredients listed in Table 1. Either VP Disp W7330N, a water-based stable fumed silica dispersion commercially available from Evonik Degussa Corporation, having 30% solids loading and using NaOH stabilization, LUDOX® SM-30, a water-based colloidal silica commercially available from Grace Davison having 30% solids loading and using NaOH stabilization, or a combination of both were used as the binder. The refractory component contained Sil-Co-Sil® 75 and Sil-Co-Sil® 125, which are fused silica powders (commercially available from U.S. Silica Company Berkeley Springs, W.V.), at 75 and 125 mesh particle size fractions, respectively. VANSIL® W, a needle-like wollastonite mineral reinforcing agent (commercially available from RT Vanderbilt & Co., Norwalk, Conn.) was also included in the compositions. The fused silicas were combined with the wollastonite using a spatula. The binder, LUDOX® SM-30 and/or VP Disp W7330N, was added and the slurry mixed using a spin mixer (Flacktec Speed Mixer DAC150).

TABLE 1

| | 100% Colloidal Si | 75% colloidal Si:25% fumed Si | 50% colloidal Si:50% fumed Si | 25% colloidal Si:75% fumed Si | 100% fumed Si |
|---|---|---|---|---|---|
| LUDOX ® SM-30 | 45 g | 33.75 g | 22.5 g | 11.25 g | |
| VP Disp W7330N | | 11.25 g | 22.5 g | 33.75 g | 45 g |
| Sil-Co-Sil ® 75 | 30 g | 30 g | 30 g | 30 g | 30 g |
| Sil-Co-Sil ® 125 | 75 g | 75 g | 75 g | 75 g | 75 g |
| VANSIL ® W | 0.45 g | 0.45 g | 0.45 g | 0.45 g | 0.45 g |
| TOTAL | 150.45 g | 150.45 g | 150.45 g | 150.45 g | 150.45 g |

Example 2

Degree of Settling and Rheologies of the Compositions Containing Colloidal and Fumed Silica Compositions containing 100% colloidal silica dispersion, 75% colloidal silica dispersion and 25% fumed silica dispersion, 50% colloidal silica dispersion and 50% fumed silica dispersion, 25% colloidal silica dispersion and 75% fumed silica dispersion, and 100% fumed silica dispersion were made according to the batches and procedure in Example 1. The compositions were allowed to stand for 18 hours with no disturbance. After 18 hours, the compositions were found to have settled, forming supernatant layers of the thicknesses listed in Table 2, expressed as a percentage of the total liquid height of the samples.

TABLE 2

| | 100% Colloidal Si | 75% colloidal Si:25% fumed $SiO_2$ | 50% colloidal Si:50% fumed $SiO_2$ | 25% colloidal Si:75% fumed $SiO_2$ | 100% fumed $SiO_2$ |
|---|---|---|---|---|---|
| Layer Thickness | 16% | 15% | 13% | 11% | 5% |

Example 3

Formation of Bars Cast Using the Compositions of Example 1

Each of the compositions of Example 1 exhibited different rheologies, and thus when each was used to coat a wax pattern by dipping layers of varying thickness were produced. Therefore, to test the strength of the molded compositions independently from their thickness, rectangular bars measuring either 2.5×30×0.6 cm or 2.5×30×0.3 cm were formed by pouring each composition of Example 1 into a two-piece mold made from acrylic sheets lined with Bytac® (a laminate of Teflon® FEP resin film bonded to a support backing of aluminum). The bars were allowed to dry overnight. After drying was completed, the mold was disassembled and the bars in the green state were removed.

Figure 2:
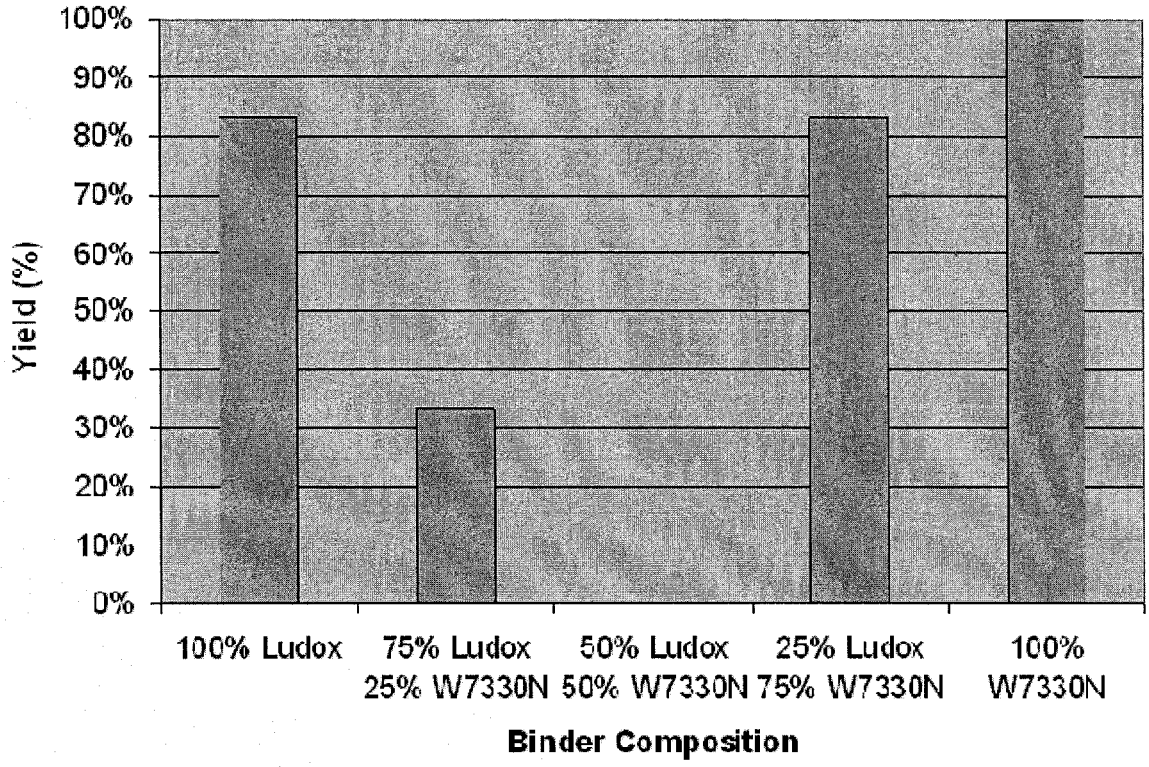
FIG. 2 is a graphical representation showing the percentage yield after drying of uncracked 25×250×6 mm bars made using varying amounts of colloidal silica and/or a dispersion of fumed silica.

In bars made using 100% LUDOX SM-30 colloidal silica as the binder, the coarse fused silica settled during drying leaving a shiny, crackled top surface. By contrast, when 100% VP Disp W7330N fumed silica was used as the binder, the coarse fused silica was held in suspension during drying, resulting in a bar that was more homogeneous through its thickness. In addition, bars made to 3 mm thickness using 100% LUDOX SM-30 exhibited edge cracking during drying. No cracking occurred in bars made using 100% VP Disp W7330N. The failure rate due to cracking during drying for each of the bars made from the different proportions of VP Disp W7330N and LUDOX SM-30, as described in Example 1, is shown in FIG. 2.

Example 4

Densities of the Bars Formed According to Example 3

The bulk densities of the green strength bars formed according to Example 3 were measured. A sample from each bar was weighed to find its mass in grams, and then each sample was sealed with polyurethane to make the porosity of the samples impenetrable by liquids. The displacement of acetone in mL by each bar was used to calculate the bulk volume of each sample, and the bulk density was calculated by dividing mass by bulk volume. The results are shown in Table 3.

TABLE 3

| Binder Composition | Dry Mass (g) | Volume (mL) | Density (g/cc) |
|---|---|---|---|
| 100% colloidal $SiO_2$:0% fumed $SiO_2$ | 3.41 | 1.775 | 1.92 |
| 75% colloidal $SiO_2$:25% fumed $SiO_2$ | 4.13 | 2.213 | 1.87 |
| 50% colloidal $SiO_2$:50% fumed $SiO_2$ | 4.83 | 2.60 | 1.86 |
| 25% colloidal SiO2:75% fumed $SiO_2$ | 4.51 | 2.438 | 1.85 |
| 100% fumed SiO2:0% colloidal $SiO_2$ | 3.55 | 1.925 | 1.84 |

Example 5

Green Strength of the Bars Formed According to Example 2

The fracture strength of the cast bars made according to Example 2 in the green state was measured using a three-point bend (or flexure) test to determine the modulus of rupture (MOR) according to the following formula:

$$MOR = \frac{3PL}{2bh^2}$$

P=fracture load (N)
L=length of sample between supports (m)
b=width of sample (m)
h=height of sample A Tinius Olsen H50KT (commercially available from Tinius Olsen, Horsham, Pa.) that has been fitted with a three-point bending fixture was used to measure the force required to break each bar. Each bar was set on top of the two lower rods of the Tinius Olsen H50KT. The upper rod was then brought down at a constant rate of 1 inch per minute until it encountered and fractured the bar. The force required to break the bar was recorded. Because MOR measurements are prone to significant variation from one sample to the next, at least 20 measurements of each composition were taken for statistical accuracy. The results are shown in Table 4 below.

TABLE 4

| Binder Composition | MOR (MPa) | Error (MPa) |
|---|---|---|
| 100% colloidal $SiO_2$:0% fumed $SiO_2$ | 3.03 | 0.63 |
| 75% colloidal $SiO_2$:25% fumed $SiO_2$ | 2.57 | 0.627 |
| 50% colloidal $SiO_2$:50% fumed $SiO_2$ | 1.65 | 0.73 |
| 25% colloidal $SiO_2$:75% fumed $SiO_2$ | 4.29 | 0.676 |
| 100% fumed $SiO_2$:0% colloidal $SiO_2$ | 5.46 | 1.09 |

Example 6

Wet Strength of the Bars Formed According to Example 3

The wet strength of the compositions was measured by the placing the bars formed according to Example 3 in the green state in a beaker of boiling water and holding there for 10 minutes while the water continued to boil. After the 10 minute period was complete, the bars in the wet state were immediately removed from the water and the MOR was tested according to Example 5. The results are shown in Table 5 below.

TABLE 5

| Binder Composition | MOR (MPa) | Error (MPa) |
|---|---|---|
| 100% colloidal $SiO_2$:0% fumed $SiO_2$ | 2.41 | 1.07 |
| 75% colloidal $SiO_2$:25% fumed $SiO_2$ | 3.17 | 0.97 |
| 50% colloidal $SiO_2$:50% fumed $SiO_2$ | 4.01 | 1.11 |
| 25% colloidal $SiO_2$:75% fumed $SiO_2$ | 4.47 | 1.42 |
| 100% fumed $SiO_2$:0% colloidal $SiO_2$ | 3.15 | 0.48 |

Example 7

Fired Strength of the Bars Formed According to Example 3

The fired strength of compositions was measured by placing the bars formed according to Example 3 in the green state in a kiln and firing to 1000° C. at a rate of 5° C./min. There was zero soak time at 1000° C., and once reached, the temperature immediately was dropped at 5° C./min to room temperature. The bars in the fired state can then be tested for MOR according to Example 5. The results are shown in Table 6.

TABLE 6

| Binder Composition | MOR (MPa) | Error (MPa) |
|---|---|---|
| 100% colloidal $SiO_2$:0% fumed $SiO_2$ | 7.59 | 2.53 |
| 50% colloidal $SiO_2$:50% fumed $SiO_2$ | 8.93 | 2.89 |
| 100% fumed $SiO_2$:0% colloidal $SiO_2$ | 7.54 | 1.66 |

Prophetic Example 8

Hot Strength of the Bars Formed According to Example 3

The hot strength of the bars formed according to Example 2 is measured by the method described in Example 5 with the exception that the testing is performed with the bars at temperatures of 1200° C. and 1000° C. The bars are heated to 1200° C. or 1000° C. at a rate of 5° C./min and immediately after reaching the desired temperature are fractured with a high-temperature 3-point testing fixture as described in Example 5. Bars formed using a binder comprising fumed silica are expected to be stronger at each temperature that bars formed using only colloidal silica as the binder.

Prophetic Example 9

Preparation of Slurries and Molds Containing Fumed Metal Oxides

Different compositions are made by combining each of the ingredients listed in Table 7. Either VP DISP® W740X, a water-based fumed titanium oxide dispersion having a 40% solids loading commercially available from Evonik Degussa Corporation, AERODISP® W630, a water-based fumed aluminum oxide dispersion commercially available from Evonik Degussa Corporation having 30% solids loading and stabilized with acetic acid, or VP DISP® W2650, a water-based fumed zirconium oxide dispersion commercially available from Evonik Degussa Corporation, having a 50% solids loading and stabilized with ammonium hydroxide is used as the binder. The refractory component contains Sil-Co-Sil® 75 and Sil-Co-Sil® 125 (fused silica powders). VANSIL® W (a wollastonite) is also included in the compositions. The fused silicas are combined with the wollastonite using a spatula. The binder, VP DISP® W740X, AERODISP® W630 or VP DISP®, is added and the slurry is mixed using a spin mixer (Flacktec Speed Mixer DAC150).

TABLE 7

| | Fumed Titanium Oxide Dispersion | Fumed Aluminum Oxide Dispersion | Fumed Zirconium Oxide Dispersion |
|---|---|---|---|
| VP DISP ® W740X | 45 g | | |
| AERODISP ® W630 | | 45 g | |
| VP DISP ® W2650 | | | 45 g |
| Sil-Co-Sil ® 75 | 30 g | 30 g | 30 g |
| Sil-Co-Sil ® 125 | 75 g | 75 g | 75 g |
| VANSIL ® W | 0.45 g | 0.45 g | 0.45 g |
| TOTAL | 150.45 g | 150.45 g | 150.45 g |

Bars are cast, as described in Example 3, from each of the compositions of Table 7. The green strength, fired strength, wet strength, and hot strength of the bars are measured according to Examples 5-8. The bars are expected to exhibit superior green strength, fired strength, wet strength, and hot strength compared with bars formed from 100% colloidal silica according to Example 3.

Example 10

Preparation of Slurries and Molds Containing Surface Modified Dispersed Fumed Silica Zircon flour (−325), LUDOX® SM30 (a colloidal silica dispersion commercially available from W.R. Grace, Columbia, Md.) and VP Disp W3530N (a chemically structure modified aqueous dispersed fumed silica, commercially available from Evonik Degussa Corporation) were mixed in the proportions outlined in Table 8 with a Jiffy blade mixer for 24 hours to form a slurry. A surfactant, VICTAWET® 12 (organic phosphate ester), commercially available from Victor Chem. Co., was added after the initial mixing period to promote wetting of the wax mold. The slurry was adjusted to a viscosity of 14 seconds, measured using a Zahn #4 cup. Plates were cast with various mass ratios of binder component (fumed and colloidal silica) to refractory in the slurry (Rw value), and with various relative mixtures of colloidal silica (LUDOX® SM-30) and fumed silica (VP Disp W3530N).

TABLE 8

Slurry composition utilizing −325 mesh zircon, incorporating varying binder types and amounts.

| Material | $R_w = 0.06$ | $R_w = 0.09$ | $R_w = 0.12$ |
|---|---|---|---|
| −325 Mesh Zircon | 2000 g | 2000 g | 2000 g |
| LUDOX ® SM-30 | (400 − x) g | (600 − x) g | (800 − x) g |
| VP Disp W3530 | x g | x g | x g |
| Deionized Water | 200 g | 100 g | 0 g |
| VICTAWET ® 12 | 0.5 g | 0.5 g | 0.5 g |

Rectangular stainless steel bars (approx. 1"×¼"×8") were coated with casting wax. The bars were dipped into the slurry and held for 10 seconds before being withdrawn. The slurry was allowed to drain off of the bars until the dripping ceased, and the coated bars were immediately dipped into a fluidized bed filled with a zircon sand stucco and were quickly removed from the stucco. The bars were incubated at 25° C. and 55% relative humidity for 1 hour. The steps of dipping the bars into the slurry and stucco, and drying for 1 hour were repeated until seven layers of slurry and stucco were deposited. The bars were then dipped into the slurry and held for 10 seconds before being withdrawn. The slurry was allowed to drain from the bars until the dripping ceased. The bars were dried overnight at 25° C. and 55% relative humidity.

The edges of the shell were sanded off, and two flat plates comprising the cast refractory were removed from the bar. A plate was placed on a standard 3-point bend fixture and loaded until fracture. For dry green testing, samples were tested when dry and at room temperature. For wet green testing, samples were boiled in water for 10 minutes before being removed from the water and immediately tested. For fired testing, samples were heated to 1000° C. and then cooled to room temperature before testing.

The maximum load applied to the sample before fracture and the thickness of the plate at the point of fracture were measured. The modulus of rupture was calculated by the formula:

$$MOR=3PL/2bh^2$$

where,

P=fracture load (N)

L=length of sample between supports (m)

b=width of sample (m)

h=thickness of sample at fracture (m)

Tables 9, 10 and 11 show the dry green strength, wet strength and fired strength results respectively) for plates cast with various mass ratios of binder component (fumed and colloidal silica) to refractory in the slurry (Rw value), and with various relative mixtures of colloidal silica (LUDOX® SM-30) and fumed silica (VP Disp W3530N).

TABLE 9

Dry strength of plates cast using different proportions of colloidal silica and aqueous dispersed fumed silica.

| | Modulus of Rupture (Psi) | | |
|---|---|---|---|
| Binder Used: | Rw = 0.06 | Rw = 0.09 | Rw = 0.12 |
| 100% LUDOX ® SM-30 | 823.78 | 865.47 | 730.06 |
| 25% VP Disp W3530N, 75% LUDOX ® SM-30 | 846.62 | 962.99 | 823.94 |
| 50% VP Disp W3530N, 50% LUDOX ® SM-30 | 865.19 | 893.30 | 883.52 |
| 75% VP Disp W3530N, 25% LUDOX ® SM-30 | 629.12 | 654.67 | 564.50 |
| 100% VP Disp W3530N | 680.73 | 623.03 | 454.01 |

TABLE 10

Wet strength of plates cast using different proportions of colloidal silica and aqueous dispersed fumed silica.

| | Modulus of Rupture (Mpa) | | |
|---|---|---|---|
| Binder Used: | Rw = 0.06 | Rw = 0.09 | Rw = 0.12 |
| 100% LUDOX ® SM-30 | 6.39 | 6.48 | 6.11 |
| 25% VP Disp W3530N, 75% LUDOX ® SM-30 | 5.63 | 5.87 | 4.56 |
| 50% VP Disp W3530N, 50% LUDOX ® SM-30 | 5.52 | 6.26 | 6.92 |

TABLE 10-continued

Wet strength of plates cast using different proportions of colloidal silica and aqueous dispersed fumed silica.

| Binder Used: | Modulus of Rupture (Mpa) Rw = 0.06 | Rw = 0.09 | Rw = 0.12 |
|---|---|---|---|
| 75% VP Disp W3530N, 25% LUDOX ® SM-30 | 4.45 | 6.18 | 3.94 |
| 100% VP Disp W3530N | 3.43 | 2.74 | 2.77 |

TABLE 11

Fired strength of plates cast using different proportions of colloidal silica and aqueous dispersed fumed silica.

| Binder Used: | Modulus of Rupture (Psi) Rw = 0.06 | Rw = 0.09 | Rw = 0.12 |
|---|---|---|---|
| 100% LUDOX ® SM-30 | 3015.9 | 3355.7 | 3018.5 |
| 25% VP Disp W3530N, 75% LUDOX ® SM-30 | 3629.4 | 3895.1 | 3636.0 |
| 50% VP Disp W3530N, 50% LUDOX ® SM-30 | 3186.3 | 3336.4 | 3205.9 |
| 75% VP Disp W3530N, 25% LUDOX ® SM-30 | 3212.2 | 3305.2 | 2809.4 |
| 100% VP Disp W3530N | 2775.9 | 2309.7 | 1574.2 |

Example 11

Preparation of Slurries and Molds Made With Fumed Alumina Dispersion

Casts were made with VP Disp® W740ZX (a fumed alumina dispersion) according to Example 10. The dry strength of the casts was measured according to Example 10 and the results are shown in Table 12.

TABLE 12

Dry Strength of casts made using VP Disp ® W740ZX (a fumed alumina dispersion) and a combination of VP Disp ® W740ZX and LUDOX ® SM-30 (a colloidal silica).

| Binder | Rw = 0.06 | Rw = 0.09 | Rw = 0.12 |
|---|---|---|---|
| 25% VP Disp ® W740ZX, 75% LUDOX ® SM-30 | | 628 psi | 451 psi |
| VP Disp ® W740ZX | | | 1153 psi |

Prophetic Example 12

Preparation of Slurries and Molds Made With Cerium Doped Silica

A cerium doped fumed silica is prepared by evaporating 4.44 kg/h of $SiCl_4$ at about 130° C. and introducing it into the central tube of the burner shown in FIG. 1. The production parameters are given in Table 13. 3 $Nm^3/h$ of primary hydrogen and 8.7 $Nm^3/h$ of air are also supplied to the central tube. The gas mixture flows out of the inner burner nozzle and burns in the combustion chamber and the water-cooled flame tube connected in series therewith. In the mantle nozzle which surrounds the central nozzle, 0.5 $Nm^3/h$ of mantle or secondary hydrogen are supplied in order to prevent caking.

The aerosol flows out of the axial tube into the central tube. The aerosol is a cerium salt aerosol which has been produced in an amount of 205 g/h by ultrasonic nebulization of a 5% aqueous cerium(III) chloride solution in the aerosol generator.

The cerium salt aerosol is passed through a heated pipe with the assistance of 0.5 $Nm^3/h$ of air as carrier gas, wherein the aerosol is converted into a gas and a salt crystal aerosol at temperatures around 180° C.

At the mouth of the burner, the temperature of the gas mixture ($SiCl_4$/air/hydrogen, aerosol) is 180° C.

The reaction gases and the resulting pyrogenically prepared silica, doped with cerium, are removed under suction via a cooling system by applying a reduced pressure and thus cooled to about 100 to 160° C. The solid is separated from the gas stream in a filter or cyclone.

The doped, pyrogenic silica is produced as a white, finely divided powder. In a further step, adhering hydrochloric acid residues are removed from the pyrogenic silica by treatment with water vapor-containing air at elevated temperatures.

TABLE 13

Silica Doped with Ceruim Salt

| $SiCl_4$ kg/h | Prim. air $Nm_3/h$ | Sec. air $Nm_3/h$ | $H_2$ core $Nm_3/h$ | $H_2$ mantle $Nm_3/h$ | $N_2$ mantle $Nm_3/h$ | Gas temp ° C. | Salt soln. | Aerosol amount kg/h | Air aeros. $Nm_3/h$ | BET $m^2/g$ |
|---|---|---|---|---|---|---|---|---|---|---|
| 4.44 | 8.7 | 12 | 3 | 0.5 | 0.3 | 180 | 0.5% $CeCl_3$ | 0.205 | 0.5 | 217 |

Notes:

Prim. air = amount of air in central tube; sec. air = secondary air; $H_2$ core = hydrogen in central tube; Gas temp. = gas temperature at the nozzle in the central tube; Aerosol amount = mass flow of salt solution converted into aerosol form; Air aerosol = carrier gas (air) in the aerosol.

The cerium doped silica is dispersed in water. Water is added to the cerium doped silica to provide a mixture that is 20% (w/w) doped silica. The pH is adjusted to 10 with NaOH and the cerium doped silica is dispersed by applying a shear of 15,000 $sec^{-1}$ using a Ystral Conti TDS-3, commercially available from Ystral Gmbh, Germany.

Slurries and molds are made according to Example 10, except that the cerium doped silica dispersion is used instead of VP Disp W3530N. The green strength, fired strength, and wet strength of the casts are measured according to Examples 10. The casts are expected to exhibit superior green strength, fired strength, and wet strength compared with casts formed from 100% colloidal silica according to Example 10.

Prophetic Example 13

Preparation of Slurries and Molds made with Potassium Doped Silica

A potassium doped fumed silica is prepared by evaporating 4.44 kg/h of $SiCl_4$ at about 130° C. and introducing it into the central tube of the burner shown in FIG. 1. The production parameters are given in Table 14. 3 $Nm^3/h$ of primary hydrogen and 8.7 $Nm^3/h$ of air are also supplied to the central tube. The gas mixture flows out of the inner burner nozzle and burns in the combustion chamber and the water-cooled flame tube connected in series therewith. In the mantle nozzle which surrounds the central nozzle, 0.5 $Nm^3/h$ of mantle or secondary hydrogen are supplied in order to prevent caking.

The aerosol flows out of the axial tube into the central tube. The aerosol is a potassium salt aerosol which has been produced in an amount of 215 g/h by ultrasonic nebulization of a 0.5% aqueous potassium chloride solution in the aerosol generator.

The potassium salt aerosol is passed through a heated pipe with the assistance of 0.5 $Nm_3$ /h of air as carrier gas, wherein the aerosol is converted into a gas and a salt crystal aerosol at temperatures around 180° C.

At the mouth of the burner, the temperature of the gas mixture ($SiCl_4$/air/hydrogen, aerosol) is 180° C.

The reaction gases and the resulting pyrogenically prepared silica, doped with potassium, are removed under suction via a cooling system by applying a reduced pressure and the particle/gas stream is thus cooled to about 100 to 160° C. The solid is separated from the gas stream in a filter or cyclone.

The doped, pyrogenically prepared silica is produced as a white, finely divided powder. In a further step, adhering hydrochloric acid residues are removed from the silica by treatment with water vapor-containing air at elevated temperatures.

TABLE 14

| Doping with potassium salt | | | | | | | | | | |
|---|---|---|---|---|---|---|---|---|---|---|
| $SiCl_4$ kg/h | Prim. air $Nm_3/h$ | Sec. air $Nm_3/h$ | $H_2$ core $Nm_3/h$ | $H_2$ mantle $Nm_3/h$ | $N_2$ mantle $Nm_3/h$ | Gas temp ° C. | Salt soln. | Aerosol amount kg/h | Air aeros. $Nm_3/h$ | BET $m^2/g$ |
| 4.44 | 8.7 | 12 | 3 | 0.5 | 0.3 | 180 | 0.5% KCl | 0.215 | 0.5 | 199 |

Notes:
Prim. air = amount of air in central tube; sec. air = secondary air; $H_2$ core = hydrogen in central tube; Gas temp. = gas temperature at the nozzle in the central tube; Aerosol amount = mass flow of salt solution converted into aerosol form; Air aerosol = carrier gas (air) in the aerosol.

The potassium doped silica is dispersed in water. Water is added to the potassium doped silica to provide a mixture that is 20% (w/w) doped silica. The pH is adjusted to 10 with NaOH and the potassium doped silica is dispersed by applying a shear of 15,000 $sec^{-1}$ using a Ystral Conti TDS-3, commercially available from Ystral Gmbh, Germany.

Slurries and molds are made according to Example 10, except that the potassium doped silica dispersion is used instead of VP Disp W3530N. The green strength, fired strength, and wet strength of the casts are measured according to Examples 10. The casts are expected to exhibit superior green strength, fired strength, and wet strength compared with casts formed from 100% colloidal silica according to Example 10.

Prophetic Example 14

Preparation of Slurries and Molds made with a Fumed Silica Dispersion

Slurries and molds are made according to Example 10 except that AERODISP® W7622 (a low viscosity, slightly alkaline, water-based dispersion of AEROSIL® (fumed silica having a particle size of 100 nm and a surface area of 300 $m^2/g$)) is used instead of VP Disp W3530N. The green strength, fired strength, and wet strength of the casts are measured according to Examples 10. The casts are expected to exhibit superior green strength, fired strength, and wet strength compared with casts formed from 100% colloidal silica according to Example 10.

Prophetic Example 15

Preparation of Slurries and Molds made with a Fumed Silica Dispersion

Slurries and molds are made according to Example 10 except that AERODISP® W7520N (a low viscosity, slightly alkaline, water-based dispersion of AEROSIL® 200 (fumed silica having a particle size of 120 nm and a surface area of 200 $m^2/g$)) is used instead of VP Disp W3530N. The green strength, fired strength, and wet strength of the casts are measured according to Examples 10. The casts are expected to exhibit superior green strength, fired strength, and wet strength compared with casts formed from 100% colloidal silica according to Example 10.

Prophetic Example 16

Preparation of Slurries and Molds made with a Fumed Mixed Metal Oxide Dispersion Slurries and molds are made according to Example 10 except that AERODISP® W7330N (a cationized fumed mixed metal oxide dispersion—fumed silica doped with fumed alumina) instead of VP Disp W3530N is used. The green strength, fired strength, and wet strength of the casts are measured according to Example 10. The casts are expected to exhibit superior green strength, fired strength, and wet strength compared with casts formed from 100% colloidal silica according to Example 10.

Prophetic Example 17

Preparation of Slurries and Molds made with a Fumed Mixed Metal Oxide Dispersion Slurries and molds are made according to Example 10 except that VP DISP W340 (a mixed fumed metal oxide dispersion—of silica and alumina) instead of VP Disp W3530N is used. The green strength, fired strength, and wet strength of the casts are measured according to Example 10. The casts are expected to exhibit superior green strength, fired strength, and wet strength compared with casts formed from 100% colloidal silica according to Example 10.

All patents, publications and references cited herein are hereby fully incorporated by reference. In case of conflict between the present disclosure and incorporated patents, publications and references, the present disclosure should control.

What is claimed is:

1. An investment casting shell comprising refractory particles, colloidal silica and a fumed metal oxide, wherein the fumed metal oxide comprises a doped fumed silica or a combination of a doped fumed silica with one or more of fumed alumina, fumed titania and fumed zirconia, and wherein the fumed metal oxide has a median secondary particle size of less than about 300 nm.

2. The investment casting shell of claim 1, wherein the fumed metal oxide is present throughout the shell.

3. The investment casting shell of claim 1, wherein the doped fumed silica comprises ions of cerium, caesium, rubidium, potassium, sodium, lithium, calcium, magnesium, beryllium, aluminum, titanium, iron, lead, fluorine, chlorine, bromine or a combination thereof.

4. The investment casting shell of claim 1, wherein the ratio of colloidal silica to fumed metal oxide is from about 20:1 to about 1:5.

5. The investment casting shell of claim 1, wherein the fumed metal oxide improves fired strength, green strength or wet strength of the shell by at least about 10% compared to a similar investment casting shell without the fumed metal oxide.

6. The investment casting shell of claim 1, wherein the fumed metal oxide decreases the surface roughness of the shell by at least about 5% compared to a similar investment casting shell without the fumed metal oxide.

7. The investment casting shell of claim 1, wherein the refractory particles comprise zircon or zirconia.

8. A method of improving the strength of an investment casting shell comprising:

(a) incorporating an aqueous dispersion of fumed metal oxide into a refractory slurry, wherein the dispersion of fumed metal oxide comprises a dispersion of doped fumed silica and wherein the fumed metal oxide has a median secondary particle size of less than 300 nm;

(b) depositing the refractory slurry and a refractory stucco in alternate layers over an investment casting shell mold, the aqueous dispersion of fumed metal oxide improving the strength of the casting.

9. The method of claim 8, wherein the fumed silica is doped with ions of cerium, caesium, rubidium, potassium, sodium, lithium, calcium, magnesium, beryllium, aluminum, titanium, iron, lead, fluorine, chlorine, bromine or a combination thereof.

10. The method of claim 8, wherein the dispersion of fumed metal oxide comprises a stable dispersion of fumed metal oxide.

11. A method of manufacturing an investment casting shell comprising:

(a) incorporating a dispersion of fumed metal oxide into a refractory slurry, wherein the dispersion of fumed metal oxide comprises a dispersion of doped fumed silica and wherein the fumed metal oxide has a median secondary particle size of less than 300 nm;

(b) depositing the refractory slurry and a refractory stucco in alternate layers over an investment casting mold.

12. The method of claim 11, wherein the fumed silica is doped with ions of cerium, caesium, rubidium, potassium, sodium, lithium, calcium, magnesium, beryllium, aluminum, titanium, iron, lead, fluorine, chlorine, bromine or a combination thereof.

13. The method of claim 11, wherein the dispersion of fumed metal oxide comprises a stable dispersion of fumed metal oxide.

* * * * *